US007943282B2

(12) United States Patent
Akioka et al.

(10) Patent No.: US 7,943,282 B2
(45) Date of Patent: May 17, 2011

(54) LIQUID DEVELOPER AND IMAGE FORMING APPARATUS

(75) Inventors: Koji Akioka, Matsumoto (JP); Takashi Teshima, Shiojiri (JP); Satoru Miura, Matsumoto (JP); Shunichiro Yamanaka, Komaki (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 808 days.

(21) Appl. No.: 11/936,664

(22) Filed: Nov. 7, 2007

(65) Prior Publication Data

US 2008/0199801 A1 Aug. 21, 2008

(30) Foreign Application Priority Data

Feb. 20, 2007 (JP) ..... 2007-040034

(51) Int. Cl.
*G03G 9/00* (2006.01)

(52) U.S. Cl. ..... 430/116; 399/239; 399/237

(58) Field of Classification Search ..... 430/116; 399/239, 237

See application file for complete search history.

(56) References Cited

U.S. PATENT DOCUMENTS

| | | | | |
|---|---|---|---|---|
| 7,563,552 | B2 * | 7/2009 | Kaiho et al. | 430/116 |
| 7,595,140 | B2 * | 9/2009 | Akioka et al. | 430/116 |
| 7,670,732 | B2 * | 3/2010 | Miura et al. | 430/45.2 |

FOREIGN PATENT DOCUMENTS

| | | | |
|---|---|---|---|
| JP | 2001098197 | A | 4/2001 |
| JP | 2005148356 | A | 6/2005 |
| JP | 2006-251252 | | 9/2006 |

* cited by examiner

*Primary Examiner* — Mark A Chapman
(74) *Attorney, Agent, or Firm* — DLA Piper LLP (US)

(57) ABSTRACT

A liquid developer includes: an insulating liquid having dispersed therein toner particles, the insulating liquid containing a fatty acid monoester that is an ester of a fatty acid and a monohydric alcohol, and the insulating liquid having an aniline point of from 5 to 80° C.

12 Claims, 4 Drawing Sheets

LIQUID DEVELOPER AND IMAGE FORMING APPARATUS

BACKGROUND

1. Technical Field

The present invention relates to a liquid developer and an image forming apparatus.

2. Related Art

A developer for developing an electrostatic latent image formed on a latent image carrying member includes a dry toner used in a dry state constituted by a material containing a colorant, such as a pigment, and a binder resin, and a liquid developer (liquid toner) constituted by a toner dispersed in an electrically insulating carrier liquid (insulating liquid).

A method using a dry toner is advantageous owing to the use of a toner in a solid state, but has a concern of adverse influence of powder to a human body and has a problem in contamination due to scattering of the toner and unevenness upon dispersing the toner. A dry toner is liable to suffer aggregation, and the size of the toner particles is difficult to reduce, whereby a toner image having high resolution is difficult to form. In the case where the size of the toner particles is relatively small, the aforementioned problems due to the powder form of the toner conspicuously arise.

In a method using a liquid developer, the toner particles in the liquid developer are effectively prevented from being aggregated, whereby fine toner particles can be used, and a binder resin having a low softening point (softening temperature) can be used. Accordingly, the method using a liquid developer is advantageous in reproducibility of a thin line image, favorable in gradation reproducibility, and excellent in color reproducibility, and is suitable for a high-speed image forming method.

However, an insulating liquid having been used in a liquid developer is constituted mainly by a petroleum hydrocarbon. In the liquid developer, the insulating liquid is attached to the surface of the toner particles upon fixing. The fixing strength has been decreased due to the presence of the insulating liquid attached to the surface of the toner particles in the liquid developer, it has been difficult to obtain sufficient fixing property.

Such an attempt has been made for solving the problems that a naturally derived oil, such as vegetable oil, is used to improve fixing strength through oxidation polymerization reaction of the oil upon fixing (as described, for example, in JP-A-2006-251252. However, the fixing strength is slightly improved with the liquid developer using a naturally derived oil, but the improvement thereof is not satisfactory. Furthermore, offset of the like problems occur upon fixing at a low temperature, which has been practiced owing to energy saving in recent years.

SUMMARY

An advantage of some aspects of the invention is to provide such a liquid developer that is excellent in storage stability and is also excellent in fixing property of toner particles to a recording medium, and to provide an image forming apparatus using the liquid developer.

According to an aspect of the invention, a liquid developer is provided that contains an insulating liquid having dispersed therein toner particles, the insulating liquid contains a fatty acid monoester that is an ester of a fatty acid and a monohydric alcohol, and the insulating liquid has an aniline point of from 5 to 80° C.

It is preferred in the liquid developer of the aspect of the invention that the insulating liquid contains an aliphatic hydrocarbon.

It is preferred in the liquid developer of the aspect of the invention that the aliphatic hydrocarbon is a saturated hydrocarbon.

It is preferred in the liquid developer of the aspect of the invention that the insulating liquid contains a silicone oil.

It is preferred in the liquid developer of the aspect the invention that the fatty acid monoester contains a saturated fatty acid as the fatty acid.

It is preferred in the liquid developer of the aspect of the invention that the fatty acid monoester contains a saturated fatty acid having from 8 to 16 carbon atoms as the fatty acid.

It is preferred in the liquid developer of the aspect of the invention that the fatty acid monoester contains an alcohol having from 1 to 4 carbon atoms as the monohydric alcohol.

It is preferred in the liquid developer of the aspect of the invention that a content of the fatty acid monoester in the insulating liquid is from 10 to 90% by weight.

It is preferred in the liquid developer of the aspect of the invention that the toner particles have an average particle diameter of from 0.7 to 3 μm.

It is preferred in the liquid developer of the aspect of the invention that the toner particles contain a polyester resin.

According to another aspect of the invention, an image forming apparatus is provided that contains: plural developing parts that form plural monochrome images different in color from each other by using plural liquid developers different in color from each other; a transferring part that transfers sequentially the plural monochrome images formed in the plural developing parts to a recording medium by conveying the recording medium, to form an unfixed color image having the transferred plural monochrome images superimposed on each other on the recording medium; and a fixing part that fixes the unfixed color image on the recording medium. The liquid developers contain each an insulating liquid having dispersed therein toner particles, the insulating liquid contains a fatty acid monoester that is an ester of a fatty acid and a monohydric alcohol, and the insulating liquid has an aniline point of from 5 to 80° C.

It is preferred in the image forming apparatus of the aspect of the invention that the developing parts contain each a developing roller having on a surface thereof a layer of the liquid developer, a photoreceptor having the monochrome image to be formed thereon by transferring the liquid developer on the developing roller, and a coating roller that feeds the liquid developer to the developing roller, and the coating roller is an anilox roller having grooves formed on a surface thereof that feeds the liquid developer to the developing roller by carrying the liquid developer with the grooves.

According to the aforementioned and other aspects of the invention, such a liquid developer is provided that is excellent in storage stability and is also excellent in fixing property of toner particles to a recording medium, and also an image forming apparatus using the liquid developer is provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
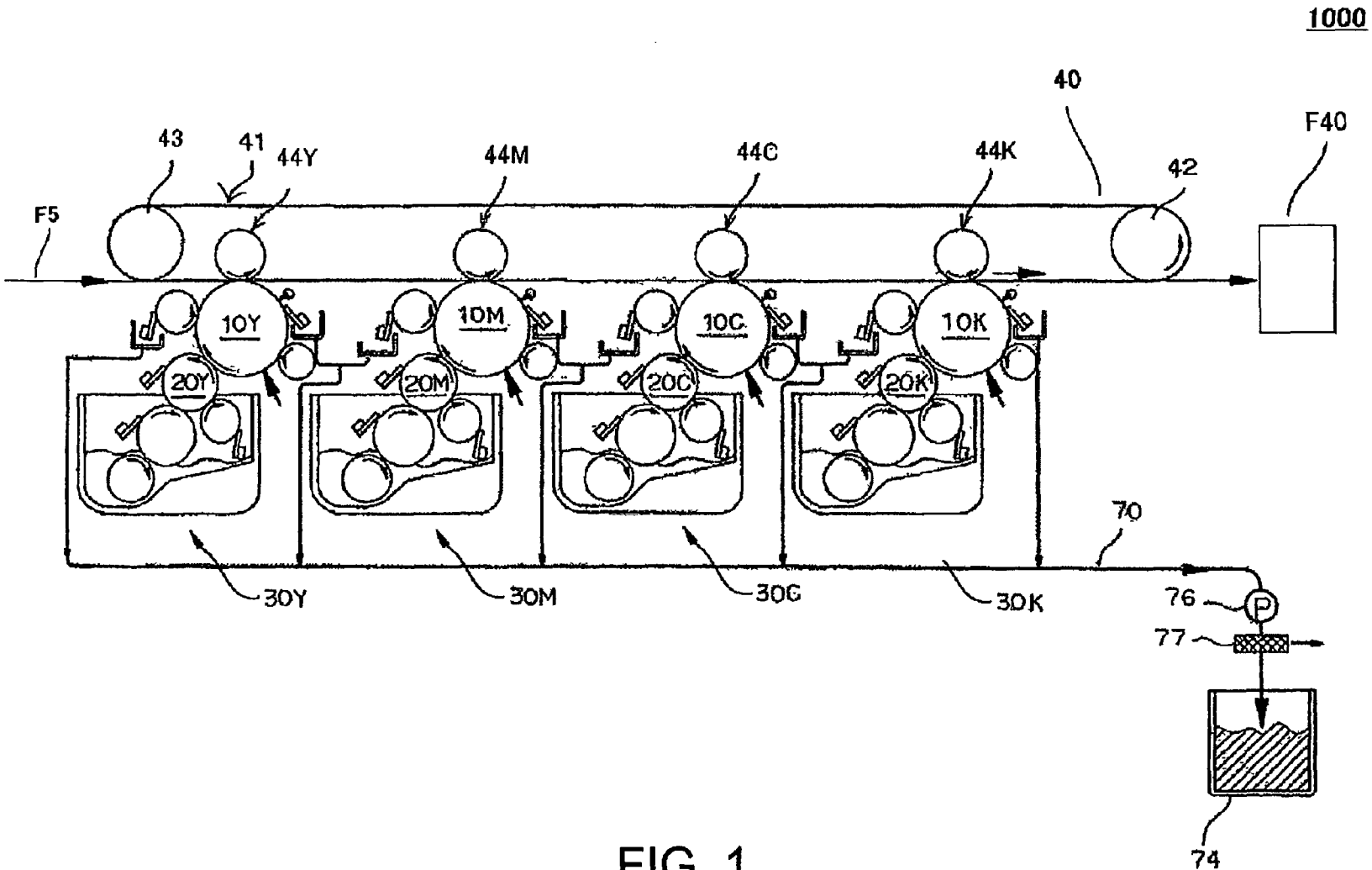
FIG. 1 is a schematic illustration showing an example of an image forming apparatus, to which a liquid developer according to an embodiment of the invention is applied.

The invention will be described in detail with reference to exemplary embodiments.

Liquid Developer

The liquid developer according to an embodiment of the invention contains an insulating liquid having dispersed therein toner particles.

Insulating Liquid

The insulating liquid used in an embodiment of the invention contains a fatty acid monoester and has an aniline point of from 10 to 80° C.

A liquid developer of the related art has had environmental issues due to an insulating liquid used therein, such as leakage of the insulating liquid outside an image forming apparatus upon use (for example, evaporation of an insulating liquid upon fixing) and disposal of a used liquid developer. A liquid developer of the related art also has had a problem of impairing fixing property of toner particles to a recording medium (i.e., decrease in fixing strength) due to the insulating liquid attached to the surface of the toner particles.

On the other hand, a fatty acid monoester used in the insulating liquid of the embodiment of the invention is an environmentally benign component. Accordingly, the environmental issues due to the insulating liquid used therein, such as leakage of the insulating liquid outside an image forming apparatus and disposal of a used liquid developer can be reduced. Consequently, an environmentally benign liquid developer can be provided.

The fatty acid monoester has a nature of facilitating permeation thereof into toner particles (resin material), and plasticizing effect is exhibited upon fixing. In the case where paper is used as the recording medium, for example, penetration of the toner particles into fibers of the paper is facilitated through the plasticizing effect, whereby the fixing strength of the toner particles is improved. Furthermore, the toner particles can be fused and fixed at a lower temperature by the plasticizing effect, whereby the liquid developer can be favorably applied to high-speed image formation at a low temperature. The fatty acid monoester also permeates a recording medium favorably, and the fatty acid monoester attached to the vicinity of the surface of the toner particles quickly permeates the recording medium at the time when the toner particles and the recording medium are in contact with each other upon fixing. A part of the toner particles (resin material constituting the toner particles) having been fused by heat upon fixing permeates the interior of the recording medium to exhibit anchoring effect associated with the permeation of the fatty acid monoester, whereby the fixing property of the toner particles to paper is improved.

The fatty acid component constituting the fatty acid monoester is not particularly limited, and examples thereof include an unsaturated fatty acid, such as oleic acid, palmitoleic acid, linoleic acid, α-linolenic acid, γ-linolenic acid, arachidonic acid, docosahexaenoic acid (DHA) and eicosapentaenoic acid (EPA), and a saturated fatty acid, such as butyric acid, lauric acid, caproic acid, caprylic acid, myristic acid, palmitic acid, stearic acid, arachidinic acid, behenic acid and lignoceric acid, which may be used solely or in combination of plural kinds of them.

In the case where the fatty acid monoester contains a saturated fatty acid as the fatty acid component, in particular, the fatty acid monoester is a chemical stable compound that hardly suffers deterioration (such as oxidation and decomposition). In this case, the insulating liquid containing the fatty acid monoester is surely prevented from suffering deterioration, such as increase in viscosity, discoloration and decrease in electric resistance, for a prolonged period of time, and the liquid developer is particularly improved in storage stability and long-term stability. The fatty acid monoester is transferred to paper associated with the toner particles upon fixing, and a toner image thus formed contains the fatty acid monoester. The saturated fatty acid monoester hardly suffers deterioration, whereby the toner image is surely prevented from suffering discoloration upon exposing the toner image to an external environment (such as light, heat and oxygen), and a sharp toner image can be maintained for a prolonged period of time.

In the case where the fatty acid monoester contains a saturate fatty acid as the fatty acid component, the fatty acid monoester preferably contains a fatty acid having from 8 to 16 carbon atoms as the fatty acid component. According to the constitution, the fatty acid monoester exhibits plasticizing effect particularly effectively upon fixing, and the liquid developer is particularly improved in fixing property. Furthermore, aggregation of the toner particles upon storing can be surely prevented.

In the case where the fatty acid monoester contains an unsaturated fatty acid as the fatty acid component, the liquid developer containing the fatty acid monoester is particularly improved in fixing property. Specifically, the fatty acid monoester permeates the toner particles upon fixing to exhibit plasticizing effect. Additionally, the unsaturated fatty acid component contained in the fatty acid monoester undergoes oxidation polymerization through heat and the like applied to the liquid developer upon fixing, and thus is cured by itself. According to the mechanism, the anchoring effect can be exhibited particularly effectively, whereby the toner particles can be firmly fixed to the recording medium. A toner image fixed to the recording medium is favorably cured through oxidation polymerization reaction of the unsaturated fatty acid component, whereby the phenomenon of adhering plural recording media with a softened resin material or the like (blocking) can be prevented particularly favorably. The toner image can maintain the excellent fixing strength for a prolonged period of time by curing through oxidation polymerization.

The fatty acid monoester is an ester of a fatty acid and a monohydric alcohol, and the alcohol is preferably an alkyl alcohol having from 1 to 4 carbon atoms. According to the constitution, the liquid developer is improved in chemical stability, and the liquid developer can be further improved in storage stability and long-term stability. The fatty acid monoester favorably permeates the toner particles upon fixing to exhibit plasticizing effect further favorably. Accordingly, the toner particles can be further firmly fixed to the recording medium. Examples of the alcohol include methanol, ethanol, propanol, butanol and isobutanol.

The fatty acid monoester preferably has a viscosity of 10 mPa·s or less, and more preferably 5 mPa·s or less. According to the constitution, the fatty acid monoester permeates the recording medium further favorably, and permeation of the toner particles fused by heat upon fixing and a fatty acid triglyceride can be surely facilitated. The constitution is also preferred for providing toner particles having a uniform particle diameter upon producing the liquid developer by the method described later. The viscosity referred herein is a viscosity measured with a vibration viscometer at 25° C. according to JIS Z8809 unless otherwise indicated.

The content of the fatty acid monoester in the insulating liquid is preferably from 10 to 90% by weight, more preferably from 15 to 80% by weight, and further preferably from 20 to 70% by weight. According to the constitution, the liquid developer is particularly improved in storage stability and long-term stability. Furthermore, the toner particles are plasticized particularly favorably, whereby the fixing property of the toner particles to the recording medium is particularly improved.

The fatty acid monoester facilitates plasticization of the toner particles, which are thus firmly fixed to the recording medium. In the case where the fatty acid monoester is simply used as a constitutional component of the insulating liquid, on the other hand, such a defect arises in that the toner particles are deformed and are aggregated with each other, and the liquid developer is deteriorated in storage stability thereby. Furthermore, upon stacking plural recording media after forming images, the phenomenon of adhering plural recording media with a resin material or the like in the toner images (blocking) is liable to occur.

As a result of earnest investigations, it has been found that in the case where the insulating liquid has an aniline point of from 5 to 80° C. in addition to the use of the fatty acid monoester as a constitutional component of the insulating liquid, the storage stability of the liquid developer can be improved while maintaining the excellent fixing property thereof, and the blocking of recording media having images formed thereon can be favorably prevented. The mechanism therefor will be specifically described. The aniline point is generally used as an index of dissolution power of an organic solvent to a resin or the like. Accordingly, the aniline point can be used as an index of the extent of exhibiting the plasticizing effect of the insulating liquid to the toner particles. Specifically, in the case where the insulating liquid has an aniline point within the aforementioned range, the fatty acid monoester can be surely prevented from permeating and plasticizing the toner particles excessively upon storing, whereby the toner particles can be favorably prevented from suffering deformation and aggregation. Upon fixing, the fatty acid monoester favorably plasticizes the toner particles, and thus the toner particles can be firmly fixed to the recording medium. Furthermore, the fatty acid monoester remaining in the toner image after image formation can prevent the resin particles of the toner from being plasticized, whereby the blocking of recording media can be favorably prevented. In the case where the aniline point of the insulating liquid is less than the lower limit, on the other hand, the plasticizing effect of the fatty acid monoester is exhibited excessively, and the toner particles are liable to suffer deformation and aggregation upon storing, which bring about deterioration in storage stability. The fatty acid monoester remaining in the toner image plasticizes the resin material, which facilitates the blocking of recording media.

In the case where the aniline point of the insulating liquid exceeds the upper limit, it is difficult to plasticize the toner particles with the fatty acid monoester upon fixing, which deteriorates the fixing property. The aniline point of the insulating liquid may be in the aforementioned range, and is preferably from 10 to 78° C., and more preferably from 20 to 72° C. According to the constitution, the aforementioned advantages can be conspicuously obtained.

The aniline point of the insulating liquid can be obtained as the minimum temperature where the same amounts of aniline and the insulating liquid are present as a uniform solution. Specifically, the aniline point is obtained in the following manner. A mixture of aniline and the insulating liquid is heated under stirring to provide a completely mixed transparent state. The temperature of the mixture is then decreased, and the temperature, at which the mixture starts to be turbid, is designated as the aniline point. The aniline point referred herein is a value that is measured and obtained according to JIS K2256.

The aniline point of the insulating liquid can be controlled to a desired range by changing the kinds and amounts of the fatty acid monoester and the constitutional components of the insulating liquid described later.

The insulating liquid may contain an aliphatic hydrocarbon.

An aliphatic hydrocarbon generally has a high electric resistance and is chemically stable. Accordingly, the liquid developer using an aliphatic hydrocarbon is particularly excellent in developing property and transferring property, and a toner image obtained therewith becomes sharp with less defects. An aliphatic hydrocarbon has high affinity with the fatty acid monoester and is liable to permeate a recording medium, such as paper. Accordingly, the insulating liquid containing the aliphatic hydrocarbon and the fatty acid monoester can quickly permeate the recording medium at the time of fixing, and the amount of the insulating liquid present among the toner particles is decreased. In the case where the liquid developer having the constitution is used, accordingly, the toner particles can be easily contacted and fused and thus can be firmly bound upon fixing to improve the fixing property and color reproducibility even though the fixing operation is carried out at a high speed and a low temperature. Therefore, the liquid developer using the insulating liquid containing the aliphatic hydrocarbon in addition to the fatty acid monoester enables a high-speed fixing operation at a low temperature and provides a toner image that is particularly improved in fixing strength. The toner image is also improved in color reproducibility. An aliphatic hydrocarbon liquid is a liquid having less hygroscopicity. Accordingly, in the case where the insulating liquid contains the aliphatic hydrocarbon, the insulating liquid can be favorably prevented from absorbing moisture upon storing, whereby the insulating liquid can be prevented from suffering modification (deterioration). Specifically, the aliphatic hydrocarbon having low hygroscopicity and high affinity with the fatty acid monoester surrounds the fatty acid monoester, whereby release of the fatty acid component from the fatty acid monoester due to contact with water can be effectively prevented from occurring. Furthermore, the aliphatic hydrocarbon is chemically stable by itself and suffers less modification (deterioration) upon storing. Consequently, the liquid developer can be particularly improved in long-term storage stability.

The aliphatic hydrocarbon used in the insulating liquid is not particularly limited, and examples thereof include Isopar E, Isopar G, Isopar H and Isopar L (available from Exxon Mobil Corp.), Cosmowhite P-60, Cosmowhite P-70 and Cosmowhite P-120 (available from Cosmo Oil Lubricants Co., Ltd.), Diana Fresia W-8, Daphne Oil CP, Daphne Oil KP, Transformer Oil H, Transformer Oil G, Transformer Oil A, Transformer Oil B and Transformer Oil S (available from Idemitsu Kosan Co., Ltd.), Shellsol 70 and Shellsol 71 (available from Shell Chemicals, Ltd.), Amsco OMS and Amsco 460 (available from American Mineral Spirits Co.), low-viscosity and high-viscosity liquid paraffin (available from Wako Pure Chemical Industries, Ltd.), octane, isooctane, decane, isodecane, decalin, nonane, dodecane, isododecane, cyclohexane, cyclooctane and cyclodecane, which may be used solely or in combination of plural kinds of them.

The aliphatic hydrocarbon preferably has a branched chain of a hydrocarbon group in the molecule thereof. According to the constitution, the aliphatic hydrocarbon becomes chemically stable, and the liquid developer using the aliphatic hydrocarbon is particularly improved in storage stability. It is considered that this is because the structure of the aliphatic hydrocarbon becomes bulky to provide a structure that hardly undergoes chemical reaction.

The aliphatic hydrocarbon preferably contains a saturated hydrocarbon. According to the constitution, the insulating liquid has a particularly high electric resistance and is particularly stable chemically. Consequently, the high electric resistance of the liquid developer can be maintained for a prolonged period of time.

The insulating liquid may contain a silicone oil.

A silicone oil is an organic compound having a siloxane bond as a skeleton. A silicone oil generally has a high electric resistance. In the case where a silicone oil is used as the insulating liquid, accordingly, the liquid developer has a particularly high electric resistance and is improved in transferring property and developing property of a toner image. The liquid developer may contain a silicone oil in addition to the fatty acid monoester as the insulating liquid, whereby a high-speed fixing operation can be carried out at a low temperature, and a resulting toner image is improved in fixing strength. It is considered that the mechanism of the phenomenon is as follows. The silicone oil is compatible with the fatty acid monoester but has low affinity with the resin constituting the toner particles. Accordingly, with the liquid developer containing the silicone oil and the fatty acid monoester, the fatty acid monoester having high affinity with the resin material selectively permeates the vicinity of the surface of the toner particles, whereby plasticizing effect is favorably exhibited upon fixing. It is considered as a result that the toner image can be firmly fixed to the recording medium even though the fixing operation is carried out at a relatively low temperature and a relatively high speed. The silicone oil has various values in viscosity depending on the kinds thereof, and thus the viscosity of the liquid developer can be optimized by selecting the silicon oil. The silicone oil is generally stable chemically and is less harmful to human health. Consequently, the liquid developer can be effectively prevented from being deteriorated to provide improved storage stability. Furthermore, the liquid developer is safe even in the case where the insulating liquid is leaked outside an image forming apparatus.

Examples of the silicone oil that can be used in the insulating liquid include KF96, KF4701, KF965, KS602A, KS603, KS604, KF41, KF54 and FA630 (produced by Shin-Etsu Silicone Co., Ltd.), TSF410, TSF433, TSF434, TSF451 and TSF437 (produced by Momentive Performance Materials Inc.), and SH200 (produced by Toray Industries, Inc.), which may be used solely or in combination of plural kinds of them.

The insulating liquid may contain other components than those described above, and examples thereof include a fatty acid triglyceride, a decomposed product of a fatty acid glyceride, such as glycerin and a fatty acid, benzene, toluene, xylene and mesitylene, which may be used solely or in combination of plural kinds of them.

The liquid developer (insulating liquid) may contain a dispersant capable of improving dispersibility of the toner particles.

Examples of the dispersant include a polymer dispersant, such as polyvinyl alcohol, carboxymethyl cellulose, polyethylene glycol, Solsperse (a trade name, produced by Lubrizol Corp. Japan), a polycarboxylic acid and a salt thereof, a polyacrylic acid metallic salt (such as a sodium salt), a polymethacrylic acid metallic salt (such as sodium salt), a polymaleic acid metallic salt (such as sodium salt), an acrylic acid-maleic acid copolymer metallic salt (such as a sodium salt), a polystyrenesulfonic acid metallic salt (such as a sodium salt) and a polyamine-fatty acid polycondensate, a clay mineral, silica, calcium triphosphate, a tristearic acid metallic salt (such as an aluminum salt), a distearic acid metallic salt (such as an aluminum salt and a barium salt), a stearic acid metallic salt (such as a calcium salt, a lead salt and a zinc salt), a linolenic acid metallic salt (such as a cobalt salt, a manganese salt, a lead salt and a zinc salt), an octanoic acid metallic salt (such as an aluminum salt, a calcium salt and a cobalt salt), an oleic acid metallic salt (such as a calcium salt and a cobalt salt), a palmitic acid metallic salt (such as a zinc salt) a dodecylbenzenesulfonic acid metallic salt (such as a sodium salt), a naphthenic acid metallic salt (such as a calcium salt, a cobalt salt, a manganese salt, a lead salt and a zinc salt) and an abietic acid metallic salt (such as a calcium salt, a cobalt salt, a manganese salt, a lead salt and a zinc salt).

In the case where a polyamine-fatty acid polycondensate is used among the dispersants, the polyamine-fatty acid polycondensate can be firmly attached to the surface of the toner particles, whereby the toner particles can be prevented from suffering unintended aggregation. Furthermore, permeation property of the fatty acid monoester into the toner particles is improved, whereby the plasticizing effect of the fatty acid monoester can be conspicuously obtained. Consequently, the toner particles can be fixed to the recording medium further firmly. The toner particles are also improved in charging property.

In the case where a polyamine-fatty acid polycondensate is used, the content of the polyamine-fatty acid polycondensate in the liquid developer is preferably from 0.5 to 7.5 parts by weight, and more preferably from 1 to 5 parts by weight, per 100 parts by weight of the toner particles. According to the constitution, the advantages obtained by using the polyamine-fatty acid polycondensate can be exhibited further conspicuously.

The insulating liquid may contain an antioxidant.

The liquid developer (insulating liquid) may contain a charge controlling agent.

Examples of the charge controlling agent include a metallic oxide, such as zinc oxide, aluminum oxide and magnesium oxide, a metallic salt of benzoic acid, a metallic acid of salicylic acid, a metallic acid of an alkylsalicylic acid, a metallic acid of catechol, a metal-containing bisazo dye, a nigrosine dye, a tetraphenylborate derivative, a quaternary ammonium salt, an alkylpyridinium salt, chlorinated polyester and nitrohumic acid.

The insulating liquid preferably has an electric resistance at room temperature (20° C.) of $1.0\times10^{11}$ Ω·cm or more, more preferably $1.0\times10^{12}$ Ω·cm or more, and further preferably $2.0\times10^{12}$ Ω·cm or more.

The insulating liquid preferably has a dielectric constant of 3.5 or less.

Toner Particles

The toner particles will be described.

Constitutional Material of Toner Particles (Toner Material)

The liquid developer according to the embodiment of the invention contains toner particles dispersed in the insulating liquid having the aforementioned constitution.

The toner particles (toner) constituting the liquid developer contain at least a resin material.

1. Resin Material

The toner constituting the liquid developer is constituted by a material containing a resin material as the major component.

The resin (binder resin) is not particularly limited in the invention, and for example, a known resin can be used. Preferred examples of the resin include those having an ester bond in the chemical structure thereof. The toner constituted by the resin that satisfies the condition has high affinity with the insulating liquid owing to the similarity in chemical structure to the fatty acid monoester. Accordingly, the toner particles are particularly improved in dispersibility in the liquid developer, and the toner particles can be further effectively prevented from being aggregated upon storing, whereby the liquid developer is particularly improved in storage stability and long-term stability. Upon fixing, furthermore, permeation of the fatty acid monoester is facilitated, whereby the plasticizing effect of the fatty acid monoester to the toner particles can be surely exhibited. Consequently, the fixing property of the toner particles to the recording medium is further improved.

Examples of the resin having an ester bond in the chemical structure thereof include a polyester resin, a styrene-acrylate ester copolymer and a styrene-methacrylate ester copolymer. Among these, a polyester resin has high transparency and can provide an image having high coloring property upon using as the binder resin.

The resin preferably has an acid value of from 0.1 to 15 mgKOH/mg, more preferably from 1 to 10 mgKOH/mg, and further preferably from 3 to 8 mgKOH/mg. The toner particles constituted by the resin material that satisfies the condition are particularly improved in affinity with the insulating liquid as described above. According to the constitution, the toner particles are improved in dispersibility in the liquid developer upon storing, whereby the toner particles can be effectively prevented from being aggregated for a prolonged period of time. Furthermore, the insulating liquid favorably permeates the toner particles upon fixing to exhibit plasticizing effect more strongly, whereby the toner particles can be fixed to the recording medium further firmly.

The softening temperature of the resin (resin material) is not particularly limited and is preferably from 50 to 130° C., more preferably from 50 to 120° C., and further preferably from 60 to 115° C. The softening temperature referred herein means a softening starting temperature determined with a Koka-type flow tester (produced by Shimadzu Corp.) under measuring conditions of a temperature increasing rate of 5° C. per minute and a die hole diameter of 1.0 mm.

2. Colorant

The toner may contain a colorant. The colorant is not particularly limited, and for example, a pigment, a dye and the like having been known may be used.

3. Other Components

The toner may contain other components than those described above. Examples of the components include wax and magnetic powder having been known.

A kneaded material constituting the toner may contain other constitutional materials (components) than those described above, for example, zinc stearate, zinc oxide, cerium oxide, silica, titanium oxide, iron oxide, a fatty acid, a fatty acid metallic salt and the like may be used. Shape, etc. of Toner Particles The toner particles used in the liquid developer according to the embodiment of the invention preferably have minute unevenness on the surface thereof. By providing the minute unevenness, the fatty acid monoester can be effectively localized (adsorbed) in the vicinity of thesurface of the toner particles.

The toner particles constituting the liquid developer preferably has an average value of circularity R (average circularity) represented by the following expression (I) of from 0.94 to 0.99, and more preferably from 0.96 to 0.99.

$$R=L_0/L_1 \quad \text{(I)}$$

wherein $L_1$ (μm) represents the peripheral length of the projected image of the toner particle to be measured, and $L_0$ (μm) represents the peripheral length of the true circle having the same area as the projected image of the toner particle to be measured.

In the case where the average circularity of the toner particles is in the range, the insulating liquid can be appropriately contained in an unfixed toner image transferred to a recording medium, whereby the fixing strength of the toner particles can be further improved.

The toner particles constituted by the aforementioned materials preferably have an average particle diameter of from 0.7 to 3 μm, more preferably from 0.8 to 2.5 μm, and further preferably from 0.8 to 2 μm. In the case where the average particle diameter of the toner particles is in the range, the toner particles can be reduced in fluctuation in properties among the particles, whereby a resolution of an image formed with the liquid developer can be sufficiently increased while maintaining the total high reliability of the liquid developer. Upon storing, furthermore, aggregation and deformation of the toner particles due to the fatty acid monoester can be surely prevented, and upon fixing, plasticization of the toner particles is particularly facilitated, whereby the toner particles can be firmly fixed to the recording medium even at a relatively low temperature. Moreover, the toner particles are improved in dispersibility in the insulating liquid to improve the storage stability of the liquid developer. The average particle diameter referred herein means an average particle diameter by volume unless otherwise indicated.

The content of the toner particles in the liquid developer is preferably from 10 to 60% by weight, and more preferably from 20 to 50% by weight.

The viscosity (viscosity measured with a vibration viscometer at 25° C. according to JIS Z8809) of the liquid developer constituted by the aforementioned components (i.e., the liquid developer according to the embodiment of the invention) is preferably from 50 to 1,000 mPa·s, more preferably from 100 to 1,000 mPa·s, and further preferably from 100 to 900 mPa·s. According to the constitution, the liquid developer appropriately permeates the recording medium, whereby the fixing property of the toner particles to the recording medium is further improved. Furthermore, an image obtained on the recording medium becomes sharp without unevenness, and moreover, the liquid developer becomes suitable particularly for high-speed image formation.

The electric resistance of the liquid developer constituted by the aforementioned components (i.e., the liquid developer according to the embodiment of the invention) at room temperature (20° C.) is preferably $1.0\times10^{11}$ Ω·cm or more, and more preferably $1.0\times10^{12}$ Ω·cm or more.

Production Method of Liquid Developer

The production method of the liquid developer of an embodiment of the invention will be described.

In the case, for example, where the insulating liquid contains the fatty acid monoester and the aforementioned components (such as the aliphatic hydrocarbon and the silicone oil), the insulating liquid can be produced by mixing the components. The liquid developer can be produced by mixing the liquid developer and the toner particles, and also can be produced in the following manner.

An embodiment of the production method of the liquid developer contains: aggregating resin fine particles constituted mainly by the resin material to form aggregated particles; and pulverizing the aggregated particles in the insulating liquid.

Preparation of Aggregated Particles

An example of a preparation method of the aggregated particles obtained by aggregating resin fine particles constituted mainly by a resin material will be described.

The aggregated particles may be prepared by any method, and in this embodiment, the aggregated particles are obtained in such a manner that an aqueous dispersion liquid containing a dispersoid (fine particles) constituted mainly by a resin material (toner material) dispersed in an aqueous dispersion medium constituted by an aqueous liquid is obtained, and the dispersoid in the aqueous dispersion liquid is aggregated to provide aggregated particles.

Preparation of Aqueous Dispersion Liquid

Preparation of the Aqueous Dispersion Liquid Will be described.

The aqueous dispersion liquid may be prepared by any method, and in this embodiment, the aqueous dispersion liquid is obtained in the following manner. The toner material is dissolved in a solvent to provide a toner material solution, and the toner material solution and an aqueous dispersion medium constituted by an aqueous liquid are mixed to provide an aqueous emulsion having a dispersoid (liquid dispersoid) containing the toner material dispersed therein. Thereafter, at least a part of the solvent contained in the aqueous emulsion is removed to provide an aqueous dispersion liquid.

The aqueous emulsion can be prepared, for example, by the following manner (preparation of the aqueous emulsion).

An aqueous dispersion medium is prepared.

The aqueous dispersion medium is constituted by an aqueous liquid.

The aqueous liquid referred herein means a liquid constituted by water and/or a liquid excellent in compatibility with water (for example, a liquid having a solubility of 30 g or more in 100 g of water at 25° C.). The aqueous liquid is constituted by water and/or a liquid excellent in compatibility with water, and is preferably constituted mainly by water. The content of water is preferably 70% by weight or more, and more preferably 90% by weight or more. By using the aqueous liquid, the dispersibility of the dispersoid in the aqueous dispersion medium can be improved, whereby the dispersoid in the aqueous emulsion has a relatively small particle diameter with less fluctuation in size. As a result, the toner particles in the liquid developer finally obtained have small fluctuation in size and shape among the particles and have a high circularity.

Specific examples of the aqueous liquid include water, an alcohol solvent, an ether solvent, an aromatic heterocyclic solvent, an amide solvent, a nitrite solvent and an aldehyde solvent.

An emulsification dispersant may be added to the aqueous dispersion medium depending on necessity. The aqueous emulsion can be prepared easily by adding an emulsification dispersant.

The emulsification dispersant is not particularly limited, and known emulsification dispersants may be used.

The toner material is dissolved in a solvent to prepare a toner material solution.

The solvent is not limited as far as it dissolves at least a part of the toner material, and a solvent having a boiling point that is lower than that of the aqueous liquid is preferably used. According to the constitution, the solvent can be easily removed.

The solvent preferably has low compatibility with the aqueous dispersion medium (aqueous liquid) (for example, a liquid having a solubility of 30 g or less in 100 g of an aqueous dispersion medium at 25° C.). According to the constitution, the toner material can be finely dispersed in the aqueous emulsion in a stable manner.

The composition of the solvent may be appropriately selected depending, for example, on the compositions of the resin and the colorant, and the composition of the aqueous dispersion medium.

The solvent is not particularly limited, and examples thereof include a ketone solvent, such as methyl ethyl ketone, an aromatic hydrocarbon solvent, such as toluene and an ester solvent, such as ethyl acetate.

A kneaded product obtained by kneading the materials for the toner, such as the resin material and the colorant, may be used for preparing the toner material solution. By using the kneaded product, the materials for constituting the toner can be in a sufficiently mixed and finely dispersed state by kneading even though the materials include such components that are less dispersible or compatible with each other. In the case where a pigment (colorant) that has relatively poor dispersibility to the solvent is used, particularly, the periphery of the pigment particles is effectively coated with the resin component and the like by preliminarily kneading before dispersing in the solvent, whereby the dispersibility of the pigment in the solvent is improved (i.e., the pigment can be finely dispersed in the solvent), and the coloring property of the toner finally obtained is also improved. Accordingly, even in the case where a component that is poor in dispersibility in the aqueous dispersion medium of the aqueous emulsion or a component that is poor in solubility in the solvent contained in the dispersion medium of the aqueous emulsion is contained in the constituents of the toner, the dispersibility of the dispersoid in the aqueous emulsion can be particularly improved.

Subsequently, the toner material solution is gradually added dropwise to the aqueous dispersion medium under stirring, whereby the aqueous emulsion having the dispersoid containing the toner material dispersed therein can be obtained. Upon adding the toner material solution dropwise, the aqueous dispersion medium and/or the toner material solution may be heated.

In alternative to the aforementioned operation, the aqueous dispersion medium may be gradually added dropwise to the toner material solution under stirring. In the case where the aqueous dispersion medium is added to the toner material solution, the toner material solution undergoes phase inversion emulsification, whereby the aqueous emulsion having the dispersoid containing the toner material dispersed in the aqueous dispersion medium can be obtained as similar to the aforementioned operation.

Thereafter, the resulting aqueous emulsion is heated or allowed to stand under a reduced pressure for removing at least a part of the solvent contained in the dispersoid, whereby the aqueous dispersion liquid having the dispersoid (fine particles) constituted by the toner material dispersed therein is obtained.

The content of the dispersoid in the aqueous dispersion liquid is not particularly limited and is preferably from 5 to 55% by weight, and more preferably from 10 to 50% by weight. According to the constitution, the productivity of the toner particles (liquid developer) can be particularly improved while the dispersoid is effectively prevented from suffering unintended aggregation in the aqueous dispersion liquid.

The average particle diameter of the dispersoid in the aqueous dispersion liquid is not particularly limited and is preferably from 0.01 to 3 μm, and more preferably from 0.1 to 2 μm. According to the constitution, the size of the toner particles finally obtained can be optimized.

Formation of Aggregated Particles

An electrolyte is added to the aqueous dispersion liquid thus obtained, whereby the dispersoid is aggregated to provide aggregated particles (formation of aggregated particles).

Examples of the electrolyte to be added include an acidic substance, such as hydrochloric acid, sulfuric acid, phosphoric acid, acetic acid and oxalic acid, and an organic or inorganic water-soluble salt, such as sodium sulfate, ammonium sulfate, potassium sulfate, magnesium sulfate, sodium phosphate, sodium dihydrogenphosphate, sodium chloride, potassium chloride, ammonium chloride, calcium chloride and sodium acetate, and these substances may be used solely or in combination of plural kinds of them. Among these, a sulfate of a monovalent cation, such as sodium sulfate and ammonium sulfate, is preferably used for attaining uniform aggregation.

Before adding the electrolyte and the like, an inorganic dispersion stabilizer, such as hydroxyapatite, and an ionic or nonionic surfactant may be added. In the case where the electrolyte is added in the presence of the dispersion stabilizer (emulsifier), uneven aggregation can be prevented from occurring.

Examples of the dispersion stabilizer include a nonionic surfactant, such as polyoxyethylene nonylphenyl ether, polyoxyethylene octylphenyl ether, polyoxyethylene decylphenyl ether, polyoxyethylene alkyl ether, polyoxyethylene fatty acid ester, sorbitan fatty acid ester, polyoxyethylene sorbitan fatty acid ester and various kinds of Pluronic series surfactant, an anionic surfactant, such as an alkyl sulfate salt surfactant, and a cationic surfactant, such as a quaternary ammonium salt surfactant. Among these, an anionic or nonionic surfactant is preferred since it is effective for improving dispersion stability with only a small addition amount. The nonionic surfactant preferably has a clouding point of 40° C. or more.

The amount of the electrolyte added is preferably from 0.5 to 15 parts by weight, more preferably from 1 to 12 parts by weight, and further preferably from 1 to 10 parts by weight, per 100 parts by weight of the solid content in the aqueous dispersion liquid. In the case where the addition amount of the electrolyte is less than the lower limit, there are some cases where aggregation of the dispersoid cannot sufficiently proceed. In the case where the addition amount of the electrolyte exceeds the upper limit, there is a possibility in that aggregation of the dispersoid proceeds unevenly to form coarse particles, whereby the toner particles finally obtained suffer fluctuation in size.

After the aggregation operation, aggregated particles are obtained by carrying out such operations as filtering, washing and drying.

The average particle diameter of the resulting aggregated particles is preferably from 0.1 to 7 μm, and more preferably from 0.5 to 3 μm. According to the constitution, the toner particles finally obtained can have an appropriate particle diameter.

Pulverization

The aggregated particles thus obtained are pulverized in the insulating liquid containing the fatty acid monoester (pulverization). According to the operation, a liquid developer having the toner particles dispersed in the liquid developer is obtained. As having been described, the fatty acid monoester is a component having high affinity with the resin material constituting the toner particles. Accordingly, the fatty acid monoester is liable to permeate among the fine particles (dispersoid) constituting the aggregated particles upon pulverizing the aggregated particles in the fatty acid monoester, whereby the aggregated particles can be efficiently pulverized with less energy.

The resulting toner particles thus obtained in this manner have unevenness derived from the fine particles (dispersoid) on the surface thereof, whereby the fatty acid monoester can be surely retained by the unevenness. Accordingly, the toner particles effectively exhibit the plasticizing effect upon fixing. Consequently, penetration of the toner particles into fibers of the paper (recording medium) is further facilitated, whereby the fixing strength of the toner particles is particularly improved.

Furthermore, since the aggregated particles are pulverized in the insulating liquid, coarse toner particles due to aggregation can be prevented from being formed.

In this embodiment, the toner particles are obtained by pulverizing the aggregated particles, whereby fine powder (particles having an excessively smaller size than the intended particles) can be effectively prevented from being formed as compared to the pulverizing method and the wet pulverizing method, which have been practiced. Consequently, deterioration of the charging property of the liquid developer due to fine powder can be effectively prevented from occurring.

The insulating liquid has a relatively small viscosity, and thus is liable to permeate among the fine particles (dispersoid) constituting the aggregated particles, whereby the aggregated particles can be favorably pulverized.

The aggregated particles may be pulverized by using a part of the insulating liquid. In this case, the same liquid as the insulating liquid used for pulverization may be added after pulverization, or in alternative, a liquid different from the insulating liquid used for pulverization may be added after pulverization. In the later case, the properties, such as viscosity, of the liquid developer finally obtained can be easily controlled.

Image Forming Apparatus

A preferred embodiment of the image forming apparatus according to an embodiment of the invention will be described.

The image forming apparatus according to the embodiment of the invention forms a color image on a recoding medium using the liquid developer according to the invention as described above.

Figure 2:
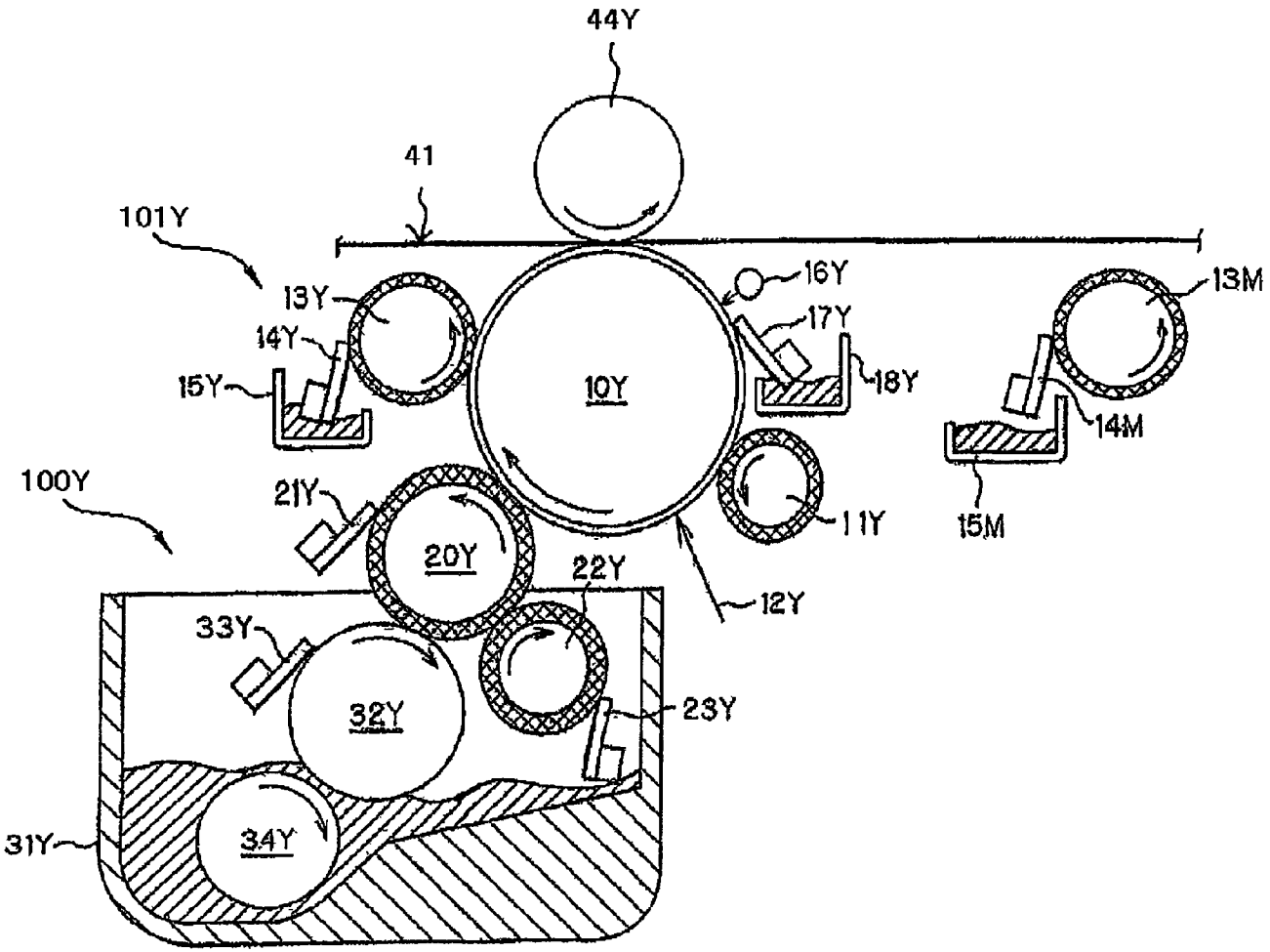
FIG. 2 is an enlarged illustration of a part of the image forming apparatus shown in FIG. 1.
Figure 3:
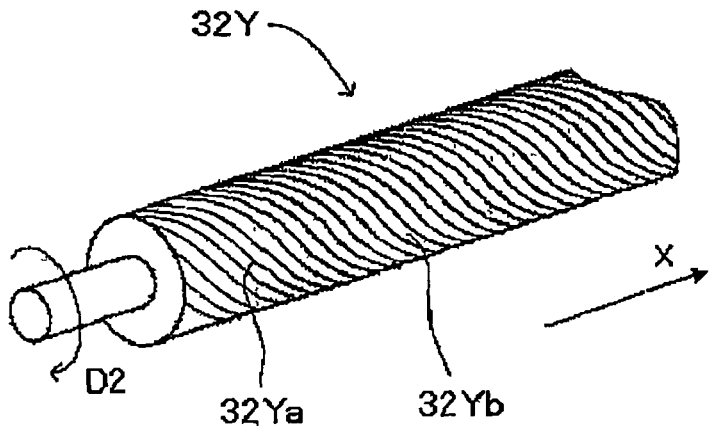
FIG. 3 is a perspective conceptual illustration showing a coating roller installed in the image forming apparatus shown in FIG. 1.
Figure 4:
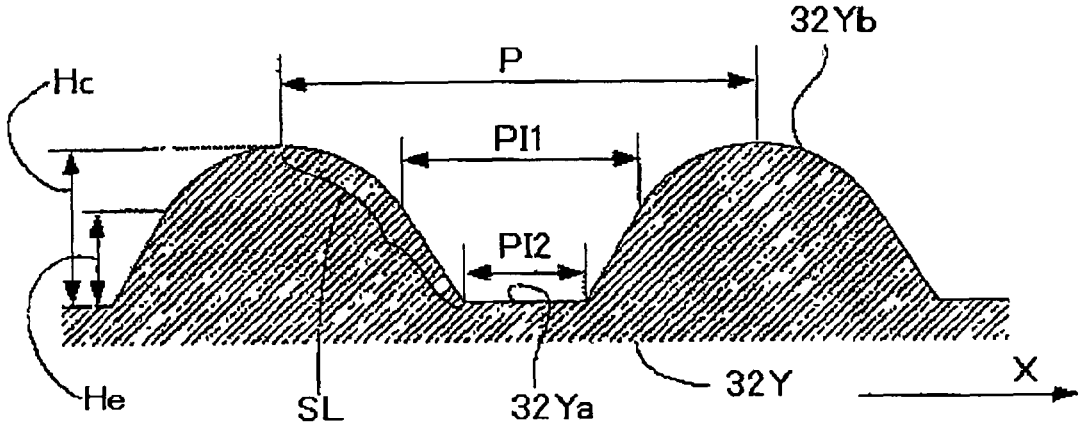
FIG. 4 is an enlarged schematic illustration of the coating roller shown in FIG. 3.
Figure 5:
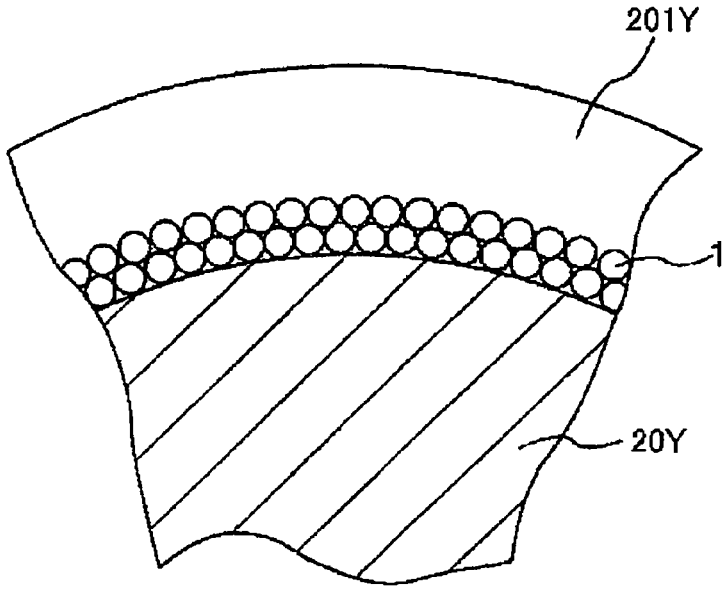
FIG. 5 is a schematic diagram showing the state of the toner particles in the liquid developer layer on the developing roller.

FIG. 1 is a schematic illustration showing an example of the image forming apparatus, to which the liquid developer according to the embodiment of the invention is applied. FIG. 2 is an enlarged illustration of a part of the image forming apparatus shown in FIG. 1. FIG. 3 is a perspective conceptual illustration showing a coating roller installed in the image forming apparatus shown in FIG. 1. FIG. 4 is an enlarged schematic illustration of the coating roller shown in FIG. 3. FIG. 5 is a schematic diagram showing the state of the toner particles in the liquid developer layer on the developing roller.

Figure 6:
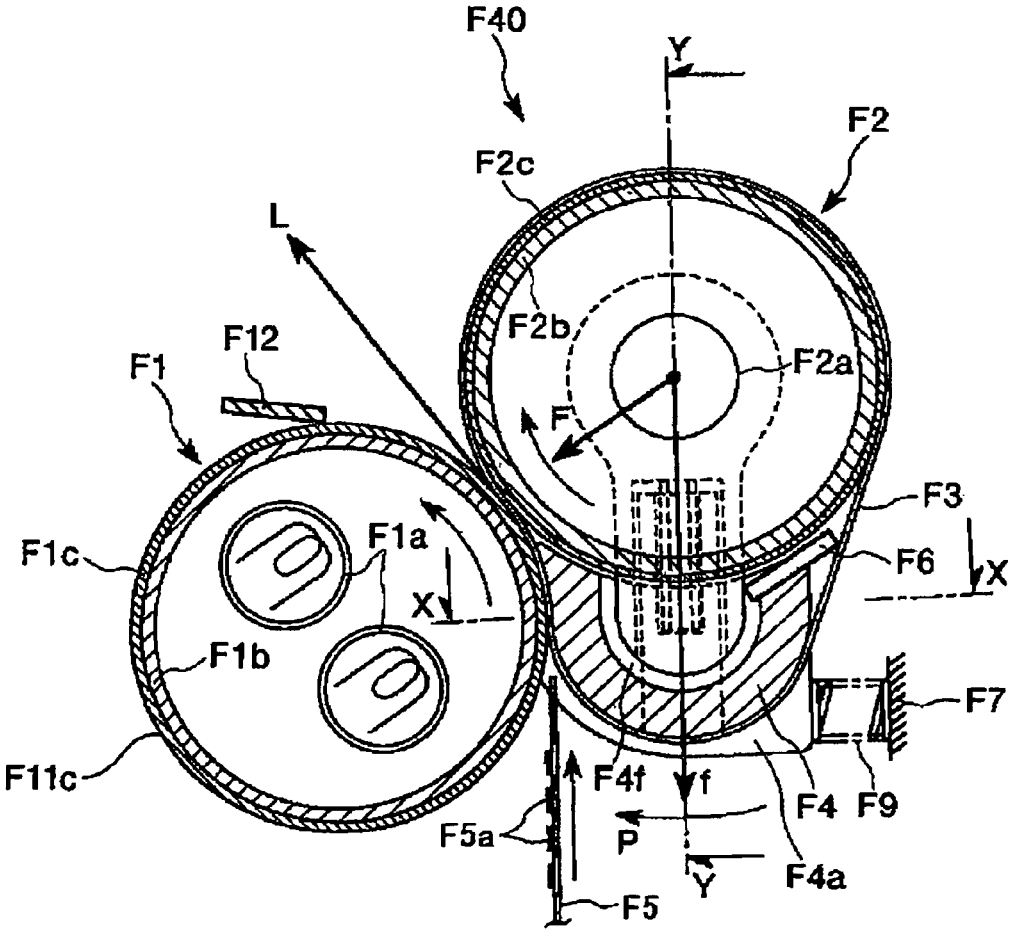
FIG. 6 is a cross sectional view showing an example of a fixing device applied to the image forming apparatus shown in FIG. 1.

FIG. 6 is a cross sectional view showing an example of a fixing device applied to the image forming apparatus shown in FIG. 1.

An image forming apparatus 1000 has, as shown in FIG. 1, four developing parts 30Y, 30M, 30C and 30K, a transferring part 40 and a fixing part (fixing device) F40.

The developing parts 30Y, 30M and 30C have a function of developing latent images with a yellow liquid developer (Y), a magenta liquid developer (M) and a cyan liquid developer (C) to form monochrome images corresponding to the colors, respectively. The developing part 30K has a function of developing a latent image with a black liquid developer (K) to form a black (K) monochrome image.

The developing parts 30Y, 30M, 30C and 30K have the same constitutions, and therefore, the developing part 30Y is described below.

The developing part 30Y has, as shown in FIG. 2, a photoreceptor 10Y as an example of an image carrying member, and has, along the rotation direction of the photoreceptor 10Y, a charging roller 11Y, an exposing unit 12Y, a developing unit 100Y, a photoreceptor squeezing device 101Y, a transfer backup roller 44Y, a destaticizing unit 16Y, a photoreceptor cleaning blade 17Y and a developer recovering part 18Y.

The photoreceptor 10Y has a tubular substrate having on an outer peripheral surface thereof a photoreceptor layer, and is rotatable with the center axis thereof as the center. In this embodiment, the photoreceptor 10Y is rotatable clockwise as shown by the arrow in FIG. 1.

A liquid developer is fed to the photoreceptor 10Y from the developing unit 100Y described later, and a layer of the liquid developer is formed on the surface thereof.

The charging roller 11Y is a device for charging the photoreceptor 10Y, and the exposing unit 12Y is a device for forming a latent image on the charged photoreceptor 10Y by radiating laser light. The exposing unit 12Y has a semiconductor laser, a polygonal mirror, an F-θ lens and the like, and radiates the photoreceptor 10Y with laser light modulated based on image signals input from a host computer, such as a personal computer and a word processor, which is not shown in the figure.

The developing unit 100Y is a device for developing the latent image formed on the photoreceptor 10Y with the liquid developer according to the embodiment of the invention. The developing unit 100Y will be described in detail later.

The photoreceptor squeezing device 101Y is disposed to face the photoreceptor 10Y on the downstream side in the rotation direction with respect to the developing unit 100Y, and is constituted by a photoreceptor squeezing roller 13Y, a cleaning blade 14Y pressed onto the photoreceptor squeezing roller 13Y for removing the liquid developer attached to the surface of the photoreceptor squeezing roller 13Y, and a developer recovering part 15Y housing the liquid developer thus removed with the cleaning blade 14Y. The photoreceptor squeezing device 101Y has a function of recovering an excessive carrier and an unnecessary fogging toner from the developer having been developed on the photoreceptor 10Y to improve the proportion of the toner particles in the developed image.

The destaticizing unit 16Y is a device for removing remaining charge on the photoreceptor 10Y after transferring the image to a recording medium F5 in the transferring part 40 described later.

The photoreceptor cleaning blade 17Y is a rubber member pressed onto the surface of the photoreceptor 10Y and has a function of scraping and removing the liquid developer remaining on the photoreceptor 10Y after transferring the image to the recording medium F5 in the transferring part 40 described later.

The developer recovering part 18Y has a function of recovering the liquid developer thus removed with the photoreceptor cleaning blade 17Y.

The transferring part 40 will be described.

The transferring part 40 has a conveying belt 41, a belt driving roller 42, a tension roller 43 and transfer backup rollers 44Y, 44M, 44C and 44K.

The conveying belt 41 is an endless elastic belt member and has a function of conveying the recording medium F5.

The conveying belt 41 is wound and stretched on the belt driving roller 42 and the tension roller 43 and is rotationally driven with the belt driving roller 42 while being in contact with the photoreceptors 10Y, 10M, 10C and 10K.

The transfer backup roller 44Y is provided at the position where the photoreceptor 10Y is in contact with the conveying belt 41, to make the transfer backup roller 44Y in contact with the conveying belt 41. Similarly, the transfer backup roller 44M, the transfer backup roller 44C and the transfer backup roller 44K are provided at the positions where the photoreceptor 10M, the photoreceptor 10C and the photoreceptor 10K are in contact with the conveying belt 41, respectively, to make the transfer backup roller 44M, the transfer backup roller 44C and the transfer backup roller 44K in contact with the conveying belt 41.

In the constitution, at the time when the recording medium F5 conveyed with the conveying belt 41 passes between the respective combinations of the photoreceptors and the transfer backup rollers, the monochrome images formed in the developing parts are transferred sequentially to the recording medium F5.

In the image forming apparatus 1000 according to the embodiment, as having been described, the monochrome images formed in the developing parts are transferred sequentially to the recording medium F5 in the transferring part 40, whereby an unfixed color image containing the plural monochrome images superimposed on each other is formed on the recording medium F5.

In the transferring part 40, the monochrome images formed on the plural photoreceptors 10Y, 10M, 10C and 10K are transferred sequentially to the recording medium F5, such as paper, a film or a cloth, which may be a sheet material having a nonsmooth surface due to fibrous materials or the like. Accordingly, the elastic belt member is used for improving the transferring property by following the nonsmooth surface of the sheet material.

A toner image (transferred image) F5*a* thus transferred to the recording medium F5 in the transferring part 40 is then conveyed to the fixing part F40 described later for fixing.

The developing units 100Y, 100M, 100C and 100K will be described in detail below. The developing unit 100Y will be described as a representative example.

The developing unit 100Y has, as shown in FIG. 2, a liquid developer storing part 31Y, a coating roller 32Y, a restricting blade 33Y, a developer agitating roller 34Y, a developing roller 20Y, a developing roller cleaning blade 21Y and a developer compressing roller (compressing member) 22Y.

The liquid developer storing part 31Y has a function of storing the liquid developer for developing a latent image formed on the photoreceptor 10Y.

The coating roller 32Y has a function of feeding the liquid developer to the developing roller 20Y.

As shown in FIG. 3, the coating roller 32Y is a so-called anilox roller, which is a metallic roller, such as an iron roller, having grooves 32Ya formed uniformly and helically on the surface thereof and having been plated with nickel, and has a diameter of about 25 mm. In this embodiment, as shown in FIG. 3, plural grooves 32Ya are formed slantwise with respect to the rotation direction D2 of the coating roller 32Y by a cutting process, a rolling process or the like.

The coating roller 32Y is in contact with the liquid developer while rotating clockwise to retain the liquid developer stored in the liquid developer storing part 31Y in the grooves 32Ya, and transports the retained liquid developer to the developing roller 20Y. Accordingly, the coating roller 32Y can coat the liquid developer onto the developing roller 20Y with the width in the X direction where the grooves 32Ya are formed.

The pitch of the grooves (i.e., the interval of the protrusions 32Yb constituting the grooves 32Ya in the X direction shown in FIG. 4) is preferably from 55 to 250 μm depending on the desired thickness of the layer of the liquid developer. In this embodiment, the pitch P of the groove is about 80 μm, the width of the protrusion is about 40 μm, the width PI1 of the upper part of the groove 32Ya is about 50 μm, the width PI2 of the bottom part of the groove 32Ya is about 30 μm, the depth He of the groove 32Ya is about 20 μm, the height Hc of the protrusion 32Yb is about 30 μm, and a slope SL is formed monotonically from the center of the protrusion 32Yb toward the bottom of the groove 32Ya. In this embodiment, the surface roughness Rz of the protrusion 32Yb R1*a* is about 1.0 μm, and the surface roughness Rz of the groove 32Ya R2*a* is about 1.0 μm.

Owing to the grooves provided on the coating roller 32Y, the liquid developer in the liquid developer storing part 31Y can be stably fed to the developing roller 20Y irrespective of the viscosity of the liquid developer. For example, in the case where the viscosity of the liquid developer is decreased by increasing the temperature inside an image forming apparatus upon operating the apparatus for a long period of time, the liquid developer can be stably fed to the developing roller in such an amount that is sufficient for developing. Accordingly, an image to be formed can be surely prevented or suppressed from suffering image unevenness in any condition where the image forming apparatus is used. Consequently, the liquid developer according to the embodiment of the invention is applied to the image forming apparatus 1000 equipped with the coating roller 32Y, whereby the toner image formed is improved in fixing property and is sharp without unevenness.

The restricting blade 33Y is in contact with the surface of the coating roller 32Y to restrict the amount of the liquid developer D on the coating roller 32Y. Specifically, the restricting blade 33Y scrapes the excessive liquid developer on the coating roller 32Y to quantitate the liquid developer D on the coating roller 32Y, which is to be fed to the developing roller 20Y. The restricting blade 33Y is formed of urethane rubber as an elastic material and supported with a restricting blade supporting member formed of a metal, such as iron. The restricting blade 33Y is provided on the side where the coating roller 32Y is rotated to come out from the liquid developer D as viewed from the vertical plane A (i.e., on the left side as viewed from the vertical plane A in FIG. 2). The restricting blade 33Y has a rubber hardness of about 77 according to JIS-A, and the hardness of the restricting blade 33Y at the part in contact with the surface of the coating roller 32Y (about 77) is lower than the hardness of the developing roller 20Y described later at the part in contact with the surface of the coating roller 32Y (about 85).

The developer agitating roller 34Y has a function of agitating the liquid developer to form a uniform dispersed state.

In the liquid developer storing part 31Y, the toner particles in the liquid developer have positive charges and the liquid developer in a uniform dispersed state by agitating with the developer agitating roller 34Y is drawn up from the liquid developer storing part 31Y through rotation of the coating roller 32Y, and then fed to the developing roller 20Y after restricting the amount of the liquid developer with the restricting blade 33Y.

The developing roller 20Y retains the liquid developer and transports the liquid developer to the developing position facing the photoreceptor 10Y for developing the latent image carried on the photoreceptor 10Y with the liquid developer.

The developing roller 20Y has a liquid developer layer 201Y formed on the surface thereof by feeding the liquid developer from the coating roller 32Y.

The developing roller 20Y has an inner core constituted by a metal, such as iron, having thereon an electroconductive elastic layer, and has a diameter of about 20 mm. The elastic layer has a two-layer structure containing a urethane rubber layer having a rubber hardness of about 30 according to JIS-A and a thickness of about 5 mm as an inner layer, and a urethane rubber layer having a rubber hardness of about 85 according to JIS-A and a thickness of about 30 mm as a surface (outer) layer. The developing roller 20Y is in contact with the coating roller 32Y and the photoreceptor 10Y with the surface layer as a contact part under pressure in an elastically deformed state.

The developing roller 20Y is rotatable with the center axis thereof as the center, and the center axis is positioned downward with respect to the center rotation axis of the photoreceptor 10Y. The developing roller 20Y is rotated in the direction (i.e., the anticlockwise direction in FIG. 2) opposite to the rotation direction (i.e., the clockwise direction in FIG. 2) of the photoreceptor 10Y. An electric field is formed between the developing roller 20Y and the photoreceptor 10Y upon developing the latent image formed on the photoreceptor 10Y.

The developer compressing roller 22Y is a device having a function of making the liquid developer retained by the developing roller 20Y into a compressed state. In other words, the developer compressing roller 22Y is a device having a function of applying an electric field having the same polarity as the toner particles 1 to the liquid developer layer 201Y, thereby localizing the toner particles 1 to the vicinity of the surface of the developing roller 20Y within the liquid developer layer 201Y as shown in FIG. 5. By localizing toner particles in this manner, the developing density (developing efficiency) can be improved, and a sharp image with high quality can be obtained thereby.

A cleaning blade 23Y is provided on the developer compressing roller 22Y.

The cleaning blade 23Y has a function of removing the liquid developer attached to the developer compressing roller 22Y.

The developing unit 100Y has a developing roller cleaning blade 21Y formed of rubber in contact with the surface of the developing roller 20Y. The developing roller cleaning blade 21Y is a device for scraping and removing the liquid developer remaining on the developing roller 20Y after completing development at the developing position. The liquid developer removed by the developing roller cleaning blade 21Y is recovered into the liquid developer storing part 31Y for reuse.

The image forming apparatus 1000 has a reusing device for reusing the insulating liquid contained in the liquid developers recovered to the developer recovering parts 15Y and 18Y.

The reusing device has a transporting path 70, through which the recovered liquid developers are transported from the developer recovering parts, a filter unit 77 that removes solid contents (such as the toner particles) contained in the liquid developers thus transported, and an insulating liquid storing part 74 that stores the insulating liquid, from which solid contents have been removed with the filter unit 77.

A pump 76 is provided on the transporting path 70, and the liquid developers recovered to the developer recovering parts are transported to the insulating liquid storing part 74 with the pump 76.

The insulating liquid thus stored in the insulating liquid storing part 74 is then appropriately transported to the developing parts with a transporting unit, which is not shown in the figures, for reuse.

The solid contents removed by the filter unit 77 are detected by a unit detecting a filter condition, which is not shown in the figures. The filter unit 77 is exchanged based on the detection result. According to the constitution, the filtering function of the filter unit 77 can be stably maintained.

The fixing part will be described.

The fixing part F40 fixes an unfixed toner image F5*a* formed in the developing part, the transferring part and the like to a recording medium F5.

As shown in FIG. 6, the fixing device F40 has a heat fixing roller F1, a pressure roller F2, a heat resistant belt F3, a belt stretching member F4, a cleaning member F6, a frame F7 and a spring F9.

The heat fixing roller (fixing roller) F1 has a roller substrate F1*b* constituted by a tubular member, an elastic member F1*c* covering the outer periphery of the roller substrate F1*b*, and columnar halogen lamps F1*a* as a heating source inside the roller substrate F1*b*, and is rotatable in the anticlockwise direction shown by the arrow in the figure.

A PFA layer is provided as a surface layer of the elastic member F*c* of the heat fixing roller F1. According to the constitution, the elastic members F1*c* and F2*c* undergo elastic deformation in the substantially same manner to form a so-called horizontal nip although the elastic members F1*c* and F2*c* are different from each other in thickness, and no difference is formed in conveying speed between the peripheral speed of the heat fixing roller F1 and the speed of the heat resistant belt F3 or the recording medium F5 described later, whereby the image fixing operation can be carried out considerably stably.

Two columnar halogen lamps F1*a* and F1*a* constituting a heat source are installed inside the heat fixing roller F1, and heating elements of the columnar halogen lamps F1*a* and F1*a* are disposed at positions different from each other. The columnar halogen lamps F1*a* and F1*a* are selectively turned on, whereby the temperatures are controlled under different conditions including the fixing nip position where the heat resistant belt F3 described later is wound on the heat fixing roller F1 and the position where the belt stretching member F4 described later is in contact with the heat fixing roller F1, and under different conditions including a recording medium having a large width and a recording medium having a small width.

The pressure roller F2 is disposed to face the heat fixing roller F1 and applies pressure to the recording medium F5 having an unfixed toner image F5*a*, through the heat resistant belt F3 described later.

The pressure roller F2 has a roller substrate F2*b* constituted by a tubular member, and an elastic member F2*c* covering the outer periphery of the roller substrate F2*b*, and is rotatable in the clockwise direction shown by the arrow in the figure.

The elastic member F1*c* of the heat fixing roller F1 and the elastic member F2*c* of the pressure roller F2 undergo elastic deformation in the substantially same manner to form a so-called horizontal nip, and no difference is formed in conveying speed between the peripheral speed of the heat fixing roller F1 and the conveying speed of the heat resistant belt F3 or the recording medium P5 described later, whereby the image fixing operation can be carried out considerably stably.

The heat resistant belt F3 is an endless loop belt that is movably stretched on the outer peripheries of the pressure roller F2 and the belt stretching member F4 and held under pressure between the heat fixing roller F1 and the pressure roller F2.

The heat resistant belt F3 has a thickness of 0.03 mm or more and is formed of a seamless belt tube having a two-layer structure containing a front surface (i.e., the side in contact with the recording medium F5) formed of PFA and a back surface (i.e., the side in contact with the pressure roller F2 and the belt stretching member F4) formed of polyimide. The heat resistant belt F3 is not limited thereto and can be formed of other materials, such as a metallic tube, such as a stainless steel tube and a nickel electroformed tube, and a heat resistant resin tube, such as a silicone tube.

The belt stretching member F4 is disposed on the upstream side of the fixing nip part of the heat fixing roller F1 and the pressure roller F2 in the conveying direction of the recording medium F5 oscillatable in the direction shown by the arrow P with the rotation axis F2*a* of the pressure roller F2 as the center.

The belt stretching member P4 stretches the heat resistant belt F3 in the tangential direction of the heat fixing roller F1 under the state where the recording medium F5 does not pass through the fixing nip part. There are some cases where the recording medium F5 is not smoothly inserted to the fixing nip part and is wrinkled at the edge thereof upon fixing, in the case where the fixing pressure is too large at the initial position, at which the recording medium F5 is inserted to the fixing nip part. By stretching the heat resistant belt F3 in the tangential direction of the heat fixing roller F1, however, an introducing port, to which the recording medium F5 can be smoothly inserted, can be formed, whereby the recording medium F5 can be stably inserted to the fixing nip part.

The belt stretching member F4 is a belt sliding member having a substantially semilunar shape that is interfit inside the heat resistant belt F3 and applies a tension f to the heat resistant belt F3 in association with the pressure roller F2 (the heat resistant belt F3 slides over the belt stretching member F4). The belt stretching member F4 is disposed at such a position that the nip part is formed by winding the heat resistant belt F3 thereon on the side of the heat fixing roller F1 with respect to the tangential direction L of the contact part under pressure of the heat fixing roller F1 and the pressure roller F2. A projected wall F4*a* is provided as being protruded from one end or both ends in the axial direction of the belt stretching member F4, and in the case where the heat resistant belt F3 is deviated toward one side in the axial direction, the deviation of the heat resistant belt F3 is regulated by making the heat resistant belt F3 in contact with the projected wall F4*a*. A spring F9 is provided in a compressed state between the side of the projected wall F4*a* opposite to the heat fixing roller F1 and the frame F7 to press lightly the projected wall F4*a* of the belt stretching member F4 onto the heat fixing roller F1, whereby the belt stretching member F4 is in contact under sliding with the heat fixing roller F1 for positioning.

The position where the belt stretching member F4 is lightly pressed onto the heat fixing roller F1 forms the nip start position, and the position where the pressure roller F2 is pressed onto the heat fixing roller F1 forms the nip end position.

In the fixing part F40, the recording medium F5 having an unfixed toner image F5*a* formed thereon is inserted to the fixing nip part from the nip start position, and then it passes between the heat resistant belt F3 and the heat fixing roller F1 and exits from the nip end position, whereby the unfixed toner image F5*a* formed on the recording medium F5 is fixed. Subsequently, the recording medium F5 is discharged in the tangential direction L of the contact part under pressure of the heat fixing roller F1 and the pressure roller F2.

The cleaning member F6 is disposed between the pressure roller F2 and the belt stretching member F4.

The cleaning member F is in contact under sliding with the inner surface of the heat resistant belt F3 to clean foreign matters and abrasion powder on the inner surface of the heat resistant belt F3. The heat resistant belt F3 is refreshed by cleaning foreign matters and abrasion powder to reduce the destabilizing factor on friction coefficient described later. A concave portion F4*f* is provided on the belt stretching member F4 for housing the foreign matters and abrasion powder removed from the heat resistant belt F3.

The fixing part F40 has a removing blade (removing unit) F12 that removes the insulating liquid attached to (remaining on) the surface of the heat fixing roller F1 after fixing the toner image F5*a* to the recording medium F5. The insulating liquid removing blade F12 removes the insulating liquid and simultaneously can remove the toner and the like transferred to the heat fixing roller F1 upon fixing.

For stably driving the heat resistant belt F3, which is stretched on the pressure roller F2 and the belt stretching member F4, with the pressure roller F2, the friction coefficient between the pressure roller F2 and the heat resistant belt F3 may be set larger than the friction coefficient between the belt stretching member F4 and the heat resistant belt F3. However, there are cases where the friction coefficient is destabilized due to insertion of foreign matters between the heat resistant belt F3 and the pressure roller F2 or the heat resistant belt F3 and the belt stretching member F4, or abrasion at the contact part of the heat resistant belt F3 with the pressure roller F2 or the belt stretching member F4.

Therefore, the winding angle of the heat resistant belt F3 on the pressure roller F2 is set smaller than the winding angle of the heat resistant belt F3 on the belt stretching member F4, and the diameter of the pressure roller F2 is set smaller than the diameter of the belt stretching member F4. According to the constitution, the length where the heat resistant belt F3 is in contact under sliding on the belt stretching member F4 to avoid the destabilizing factors due to time-lapse deterioration and external disturbance, whereby the heat resistant belt F3 can be stably driven with the pressure roller F2.

The heat applied by the heat fixing roller F1 (fixing temperature) is preferably from 80 to 200° C., and more preferably from 100 to 180° C.

The invention has been described with reference to the preferred embodiments, but the invention is not construed as being limited thereto.

For example, the liquid developer according to the embodiment of the invention is not limited to the liquid developing device and the fixing device described above.

The liquid developer of the embodiment of the invention is not limited to those obtained in the production methods described above.

In the aforementioned embodiments, an aqueous dispersion liquid is obtained, and an electrolyte is added to the aqueous emulsion to provide aggregated particles, but the invention is not limited thereto. For example, the aggregated particles may be those obtained by an emulsion polymerization aggregation method, in which a colorant, a monomer, a surfactant and a polymerization initiator are dispersed in an aqueous liquid, an aqueous dispersion liquid is prepared by emulsion polymerization, and an electrolyte is added to the aqueous dispersion liquid to attain aggregation, and may be those obtained by spray-drying the resulting aqueous dispersion liquid to provide the aggregated particles.

EXAMPLES

(1) Production of Liquid Developer

Example 1

Preparation of Colorant Master Solution

A mixture (50/50 by mass) of a polyester resin (softening temperature: 113° C., glass transition point: 53° C.) and a cyan pigment (Pigment Blue 15:3, produced by Dainichiseika Color & Chemicals Mfg. Co., Ltd.) as a colorant was prepared. The components were mixed with a 20-L Henschel mixer to obtain a raw material for producing a toner.

The raw material (mixture) was kneaded with a biaxial kneading extruder. The kneaded product extruded from the extrusion port of the biaxial kneading extruder was cooled.

The kneaded product thus cooled was coarsely pulverized to form powder having an average particle diameter of 1.0 mm or less. A hammer mill was used for pulverization of the kneaded product.

Methyl ethyl ketone was added to the kneaded product powder to make the solid content to 30% by mass, and the mixture was subjected to wet dispersion with Eiger Motor Mill (Model M-1000, produced by Eiger Machinery, Inc., U.S.) to prepare a colorant master solution.

Preparation of Resin Solution 200 parts by weight of methyl ethyl ketone and 73 parts by weight of the polyester resin were added to 33 parts by weight of the colorant master solution and mixed with Eiger Motor Mill (Model M-1000, produced by Eiger Machinery, Inc., U.S.) to prepare a resin solution. The pigment was finely dispersed uniformly in the solution.

Preparation of Aqueous Emulsion 500 parts by weight of the resin solution and 45.5 parts by weight of methyl ethyl ketone were placed in a 2-L separable flask equipped with Maxblend agitation blades to make the solid content of the resin solution to 55%.

41.7 parts by weight of 1N aqueous ammonia (1.1 molar equivalent ratio to the total amount of carboxyl groups of the polyester resin) was added to the resin solution in the flask, and the mixture was sufficiently agitated by mean of a three-one motor (produced by Shinto Scientific Co., Ltd.) at a revolution number of 210 rpm (peripheral speed of agitation blades: 0.71 m/s). Thereafter, 133 parts by weight of deionized water was added thereto under agitation. The temperature of the solution in the flask was adjusted to 25° C., and 133 parts by weight of deionized water was added dropwise to the resin solution under agitation to effect phase inversion emulsification, whereby an aqueous emulsion having the dispersoid including the resin material dispersed therein was obtained.

Production of Aggregated Particles by Aggregation 285 parts by weight of deionized water was added to the aqueous emulsion while agitation of the content in the flask was continued to make the total amount of the 1 N aqueous ammonia and water to 593 parts by weight. Subsequently, 2.6 parts by weight of an anionic emulsifier, Emal 0 (produced by Kao Corp.), was dissolved in 30 parts by weight of deionized water and added to the aqueous emulsion.

Thereafter, 300 parts by weight of a 3.5% ammonium sulfate aqueous solution was added dropwise to the aqueous emulsion at a revolution number of agitation of 150 rpm (peripheral speed of agitation blades: 0.54 m/s) while maintaining the temperature of the aqueous emulsion to 25° C. to obtain a diameter of the aggregated product of the dispersoid of 3.5 μm. After completing the dropwise addition, the agitation operation was continued until the particle diameter of the aggregated product of the dispersoid was increased to 5.0 μm, and thus the aggregation operation was completed.

The resulting aggregated product dispersion liquid was dried by distilling off the organic solvent under reduced pressure to obtain aggregated particles.

Preparation of Liquid Developer 40 parts by weight of the aggregated particles obtained in the aforementioned manner, 60 parts by weight of methyl soybean oil fatty acid ester (aniline point: 8° C., viscosity: 5.1 mPa·s, produced by The Nisshin OilliO Group, Ltd.), 100 parts by weight of Cosmowhite P-60 (aniline point: 103° C., viscosity: 15 mPa·s, produced by Cosmo Oil Lubricants Co., Ltd.) as an aliphatic hydrocarbon, 2 parts by weight of a polyamine fatty acid polycondensate (Solsperse 11200, produced by Lubrizol Corp. Japan) and 0.5 part by weight of aluminum stearate (produced by NOF Corp.) were placed in a ceramic pot (internal capacity: 600 mL), and zirconia balls (ball diameter: 1 mm) were placed in the ceramic pot to make the volume filling rate to 30%. The mixture in the pot was pulverized with a desktop pot mill at a revolution number of 220 rpm (1 min) for 200 hours, and the dispersion liquid in the pot was separated from the zirconia balls to obtain a toner particle dispersion liquid.

The resulting liquid developer had an average particle diameter (volume average particle diameter) of the toner particles of 1.5 μm and a standard deviation of particle diameter among the toner particles of 0.64 μm. The viscosity of the liquid developer measured with a vibration viscometer at 25° C. according to JIS Z8809 was 270 mPa·s. The liquid developer had an electric resistance of $2.6\times10^{12}$ Ω·cm. A mixture of the methyl soybean oil fatty acid ester and Cosmowhite P-60 in the aforementioned ratio had an aniline point of 66.3° C.

The average particle diameter and the particle size distribution of the particles in Examples and Comparative Examples were measured with a particle analyzer, Mastersizer 2000 (produced by Malvern Instruments, Ltd.). The aniline point of the insulating liquid was measured with an automatic aniline point measuring machine (Model RAP-OlUF, produced by Rigo Co., Ltd.).

Example 2

A liquid developer was produced in the same manner as in Example 1 except that methyl laurate (aniline point: 3° C., viscosity: 2.5 mPa·s, produced by Lion Corp.) was used instead of the methyl soybean oil fatty acid ester to make the formulation of the insulating liquid shown in Tables 1-1 to 1-3.

Examples 3 to 14

Liquid developers were produced in the same manner as in Example 1 except that the constitution of the toner particles and the formulation of the insulating liquid were changed as shown in Tables 1-1 to 1-3.

Example 15

A liquid developer was produced in the same manner as in Example 1 except that a palm oil ester exchanged oil (viscosity: 3.7 mPa·s, Exceparl MC, produced by Kao Corp.), which was formed through ester exchange reaction of palm oil as an oil and methanol, was used instead of the methyl soybean oil fatty acid ester, and Isopar H (aniline point: 84° C., produced by Exxon Mobil Corp.) was used as an aliphatic hydrocarbon instead of Cosmowhite P-60. The palm oil ester exchanged oil (methyl palm oil fatty acid ester) contained, as fatty acid components, 52% by weight of lauric acid, 13% by weight of myristic acid, 10% by weight of oleic acid and 8% by weight of palmitic acid.

Example 16

A liquid developer was produced in the same manner as in Example 1 except that a palm oil ester exchanged oil, which was formed through ester exchange reaction of palm oil as an oil and isobutanol, was used instead of the methyl soybean oil fatty acid ester. The palm oil ester exchanged oil (isobutyl palm oil fatty acid ester) contained, as fatty acid components, 52% by weight of lauric acid, 13% by weight of myristic acid, 10% by weight of oleic acid and 8% by weight of palmitic acid.

Comparative Examples 1 to 4

Liquid developers were produced in the same manner as in Example 1 except that the constitution of the toner particles and the formulation of the insulating liquid were changed as shown in Tables 1-1 to 1-3.

For Examples and Comparative Examples, Tables 1-1 to 1-3 show the constitution of the toner particles, the formulation of the insulating liquid, the viscosity of the liquid developer, the electric resistance of the liquid developer, and the like.

In Tables 1-1 to 1-3, PEs represents a polyester resin, St-Ac represents a styrene-acrylate copolymer, EP represents an epoxy resin, as a resin component, MeOH represents methanol, EtOH represents ethanol and i-BuOH represents isobutanol, as an alcohol component of a fatty acid monoester, and LA represents lauric acid, MR represents myristic acid, OL represents oleic acid, PL represents palmitic acid, LN represents linoleic acid and LL represents linolenic acid, as a fatty acid component of a fatty acid monoester. In Examples and Comparative Examples, in addition to the constituents of the insulating liquid described above, Diana Fresia W-8 (aniline point: 98° C., viscosity: 14 mPa·s, produced by Idemitsu Kosan Co., Ltd.), Isopar E (aniline point: 75° C., produced by Exxon Mobil Corp.) and Isopar G (aniline point: 83° C., produced by Exxon Mobil Corp.) as an aliphatic hydrocarbon, KF 96 (aniline point: 123° C., viscosity: 100 mPa·s, produced by Shin-Etsu Silicone Co., Ltd.) as a silicone oil, soybean oil (aniline point: 12° C., produced by The Nisshin OilliO Group, Ltd.), and the like were appropriately selected and used as shown in Tables 1-1 to 1-3.

The viscosity and electric resistance in Table 1-3 were evaluated based on the following four grades.

Viscosity

Excellent (A): 100 mPa·s or more and 900 mPa·s or less

Good (B): 100 mPa·s or more and 1,000 mPa·s or less (except for 100 mPa·s or more and 900 mPa·s or less)

Allowable (C): 50 mPa·s or more and less than 100 mPa·s

Poor (D): less than 50 mPa·s or more or more than 1,000 mPa·s

Electric Resistance

Excellent (A): $2.0\times10^{12}$ Ω·cm or more

Good (B): $1.5\times10^{12}$ Ω·cm or more and less than $2.0\times10^{12}$ Ω·cm

Allowable (C): $1.0\times10^{12}$ Ω·cm or more and less than $1.5\times10^{12}$ Ω·cm Poor (D): less than $1.0\times10^{12}$ Ω·cm

TABLE 1

| | Liquid developer | | | | | | | | | | | |
|---|---|---|---|---|---|---|---|---|---|---|---|---|
| | Insulating liquid | | | | | | | | | | | |
| | Toner particles | | | Fatty acid monoester | | | | Major components other than fatty acid monoester | | | | |
| | Resin material | | Average particle | | | | | | | | | |
| | Resin | Softening point (° C.) | diameter (μm) | Kind | Alcohol component | Major fatty acid component (order for larger amount from left) | Content in insulating liquid (% by weight) | Kind | Content in insulating liquid (% by weight) | Aniline point (° C.) | Viscosity | Electric resistance |
| Example 1 | PEs | 113 | 1.5 | methyl soybean oil fatty acid ester | MeOH ($C_1$) | LN, OL, PL, LL | 36.9 | Cosmowhite P-60 | 61.5 | 66.3 | A | A |
| Example 2 | PEs | 113 | 1.5 | methyl laurate | MeOH ($C_1$) | LA | 36.9 | Cosmowhite P-60 | 61.5 | 64.5 | A | A |
| Example 3 | PEs | 113 | 1.6 | methyl laurate | MeOH ($C_1$) | LA | 70 | soybean oil | 28.5 | 5.5 | B | B |
| Example 4 | PEs | 113 | 1.6 | methyl soybean oil fatty acid ester | MeOH ($C_1$) | LN, OL, PL, LL | 98.5 | — | 0 | 8.0 | B | B |
| Example 5 | PEs | 116 | 1.6 | methyl soybean oil fatty acid ester | MeOH ($C_1$) | LN, OL, PL, LL | 15 | Isopar G | 84.5 | 72.2 | A | A |
| Example 6 | PEs | 116 | 1.6 | methyl soybean oil fatty acid ester | MeOH ($C_1$) | LN, OL, PL, LL | 88.5 | Cosmowhite P-60 | 10 | 17.4 | A | B |
| Example 7 | PEs | 113 | 1.5 | methyl laurate | MeOH ($C_1$) | LA | 93.5 | Cosmowhite P-60 | 5 | 8.0 | B | B |
| Example 8 | PEs | 113 | 1.5 | methyl soybean oil fatty acid ester | MeOH ($C_1$) | LN, OL, PL, LL | 6 | Isopar G | 92.5 | 78.2 | A | A |
| Example 9 | St-Ac | 117 | 1.7 | methyl laurate | MeOH ($C_1$) | LA | 36.9 | Cosmowhite P-60 | 61.5 | 64.5 | A | A |
| Example 10 | EP | 109 | 1.7 | methyl laurate | MeOH ($C_1$) | LA | 36.9 | Cosmowhite P-60 | 61.5 | 64.5 | A | A |
| Example 11 | PEs | 113 | 1.6 | methyl soybean oil fatty acid ester | MeOH ($C_1$) | LN, OL, PL, LL | 36.9 | Cosmowhite P-60<br>soybean oil | 30.8<br>30.8 | 38.4 | A | B |
| Example 12 | PEs | 113 | 1.6 | methyl laurate | MeOH ($C_1$) | LA | 41.9 | KF96 | 56.5 | 70.8 | B | A |
| Example 13 | PEs | 113 | 1.6 | methyl laurate | MeOH ($C_1$) | LN, OL, PL, LL | 36.9 | Diana Fresia W-8 | 61.5 | 61.4 | A | A |
| Example 14 | PEs | 113 | 1.5 | methyl laurate | EtOH ($C_2$) | LA | 36.9 | Isopar G | 61.5 | 62.5 | A | A |
| Example 15 | PEs | 113 | 1.6 | methyl palm oil fatty acid ester | MeOH ($C_1$) | LA, MR, OL, PL | 36.9 | Isopar M | 61.5 | 63.1 | A | A |
| Example 16 | PEs | 113 | 1.5 | isobutyl palm oil fatty acid ester | i-BuOH ($C_4$) | LA, MR, OL, PL | 36.9 | Cosmowhite P-60 | 61.5 | 64.8 | A | A |
| Comparative Example 1 | PEs | 113 | 1.8 | — | — | — | — | soybean oil | 98.5 | 12.0 | D | B |
| Comparative Example 2 | PEs | 113 | 1.4 | — | — | — | — | Isopar E | 98.5 | 75.0 | A | A |
| Comparative Example 3 | PEs | 113 | 1.8 | methyl laurate | MeOH ($C_1$) | LA | 20 | Cosmowhite P-60 | 78.5 | 81.5 | A | A |
| Comparative Example 4 | PEs | 113 | 1.5 | methyl laurate | MeOH ($C_1$) | LA | 97 | Cosmowhite P-60 | 1.5 | 4.5 | A | C |

(2) Evaluation

The liquid developers thus obtained were evaluated in the following manner.

(2-1) Fixing Strength

Monochrome images having a prescribed pattern were formed on recording paper (high quality paper, LPCPPA4, produced by Seiko Epson Corp.) with the liquid developers obtained in Examples and Comparative Examples using an image forming apparatus shown in FIGS. 1 to 6. The images were then heat fixed with the temperature of the heat fixing roller set to 120° C.

Thereafter, the non-offset area was confirmed, and then the fixed image on the recording paper was rubbed with a rubber eraser (sand eraser, LION 261-11, produced by Lion Office Products Corp.) twice with a pressing load of 1.0 kgf. The remaining rate of the image density was measured with X-Rite Model 404, produced by X-Rite, Inc., and evaluated based on the following five grades.

Excellent (A): image density remaining rate of 95% or more

Good (B): image density remaining rate of 90% or more and less than 95%

Allowable (C): image density remaining rate of 80% or more and less than 90%

Slightly poor (D): image density remaining rate of 70% or more and less than 80%

Poor (E): image density remaining rate of less than 70%

(2-2) Low Temperature Fixing Property

The toners obtained in Examples and Comparative Examples were evaluated for favorably fixable range and low temperature fixing property.

An image forming apparatus having the same constitution as shown in FIGS. 1 to 5 except that the apparatus had no fixing device was prepared. Image samples having an unfixed monochrome toner image formed on a recording medium (high quality paper, produced by Seiko Epson Corp.) were prepared by using the image forming apparatus. The solid image on the samples had an attached amount of the toner set to 0.5 mg/cm$^2$.

The surface temperature of the fixing roller of the fixing device constituting the image forming apparatus was set to a prescribed temperature, and the recording medium having the unfixed toner image formed thereon was inserted into the fixing device shown in FIG. 6, whereby the toner image was fixed to the recording medium. The occurrence of offset after fixing was then confirmed visually. In the fixing device, the speed where the toner passed through the nip part was set at 150 mm/s.

The same operation was repeated with the set temperature of the surface of the fixing roller varying from 70 to 160° C., and the occurrence of offset at the temperatures was confirmed. The maximum temperature where low temperature offset occurred was designated as a low temperature offset occurring temperature, which was evaluated based on the following four grades.

A: low temperature offset occurring temperature of less than 90° C.

B: low temperature offset occurring temperature of 90° C. or more and less than 100° C.

C: low temperature offset occurring temperature of 100° C. or more and less than 110° C.

D: low temperature offset occurring temperature of 110° C. or more (2-3) Storage Stability The liquid developers obtained in Examples and Comparative Examples were allowed to stand under an environment at a temperature of from 15 to 25° C. for 6 months. Thereafter, the state of the toner contained in the liquid developer was visually observed and evaluated based on the following five grades.

A: Completely no floatage or precipitation due to aggregation of toner particles found B: Substantially no floatage or precipitation due to aggregation of toner particles found C: Slight floatage and precipitation due to aggregation of toner particles found without problem upon using as liquid developer D: Floatage and precipitation due to aggregation of toner particles clearly found E: Floatage and precipitation due to aggregation of toner particles considerably found (2-4) Environmental Stability (Long-Term Stability)

The liquid developers obtained in Examples and Comparative Examples were allowed to stand under an environment at a temperature of 35° C. and a relative humidity of 65% for 6 months. Thereafter, the state of the liquid developer was observed, and changes in viscosity, color, acid value and electric resistance before and after allowing to stand were evaluated based on the following five grades. The acid value was measured according to JIS K2501. The change in color of the liquid developer was evaluated visually. The viscosity was measured with a vibration viscometer according to JIS Z8809. The electric resistance was measured with Universal Electrometer MMA II-17B with an electrode for liquid LP-05 and a shield box P-618 (produced by Kawaguchi Electric Works, Co., Ltd.).

A: Completely no change in viscosity, color, acid value and electric resistance found in the liquid developer B: Substantially no change in viscosity, color, acid value and electric resistance found in the liquid developer C: Slight change in viscosity, color, acid value and electric resistance found without problem upon using as liquid developer D: Change in viscosity, color, acid value and electric resistance clearly found in the liquid developer E: Change in viscosity, color, acid value and electric resistance considerably found in the liquid developer (2-5) Evaluation for Anti-Blocking Property on Fixed Printed Image The toners obtained in Examples and Comparative Examples were evaluated for resistance to blocking (anti-blocking property) in the following manner.

An image forming apparatus having the same constitution as shown in FIGS. 1 to 6 was prepared. Using the image forming apparatus, a monochrome toner image having a prescribed pattern was transferred to a recording medium (high quality paper, produced by Seiko Epson Corp.) to make a toner weight of the toner image formed on the recording medium of 0.75 mg/cm$^2$, and then fixed to provide fixed toner image.

Two recording media having the images formed thereon were superimposed to each other to make the toner images in closely contact with each other, and the toner images on the recording media were made in closely contact with each other at 55° C. for 24 hours by placing a weight on the recording media to apply a load of 1.0 kgf/cm$^2$. Thereafter, the weight was removed from the recording media, and the recording media were allowed to stand for cooling to room temperature (25° C.).

After cooling, the two recording media were released from each other to peel off the toner images that had been in closely contact with each other. The toner images thus peeled off were visually observed, and the presence of attached powder, gloss unevenness and density unevenness was evaluated based on the following four grades.

A: Completely no attached powder, gloss unevenness and density unevenness found in the fixed toner image B: Substantially no attached powder, gloss unevenness and density unevenness found in the fixed toner image C: Slight attached powder, gloss unevenness and density unevenness found in the fixed toner image D: Attached powder, gloss unevenness and density unevenness clearly found in the fixed toner image The results obtained are shown in Table 2.

TABLE 2

| | Fixing property | | | | |
|---|---|---|---|---|---|
| | Fixing strength | Low temperature fixing property | Storage stability | Long-term stability | Anti-blocking property |
| Example 1 | A | A | A | B | A |
| Example 2 | A | A | A | A | B |
| Example 3 | A | A | C | C | C |
| Example 4 | A | A | B | C | C |
| Example 5 | B | B | A | B | A |
| Example 6 | A | A | B | B | C |
| Example 7 | A | A | C | C | C |
| Example 8 | C | C | A | B | A |
| Example 9 | A | B | A | A | B |
| Example 10 | C | C | A | A | A |
| Example 11 | A | A | A | C | A |
| Example 12 | A | A | A | B | B |
| Example 13 | A | A | A | B | A |
| Example 14 | B | A | A | A | B |
| Example 15 | A | A | B | A | B |
| Example 16 | B | A | A | B | C |
| Comparative Example 1 | D | C | D | D | B |
| Comparative Example 2 | E | D | A | A | A |
| Comparative Example 3 | E | D | A | A | B |
| Comparative Example 4 | A | A | E | E | D |

It was understood from the results shown in Table 2 that the liquid developers according to the embodiments of the invention were excellent in environmental stability (long-term stability), storage stability, fixing property and anti-blocking property. The liquid developers of the comparative examples failed to provide sufficient results.

An image was formed by using a coating roller without grooves instead of the anilox roller. As a result, a sharp toner image without unevenness was obtained by using the anilox roller as the coating roller as compared to the case using the coating roller without grooves.

Production and evaluation of liquid developers were carried out in the same manner as above except that Pigment Red 122, Pigment Yellow 180 and carbon black (Printex L, produced by Degussa AG) were used as a colorant instead of the cyan pigment, and as a results, the similar results as above were obtained.

What is claimed is:

1. A liquid developer comprising:

an insulating liquid having dispersed therein toner particles, the insulating liquid containing a fatty acid monoester that is an ester of a fatty acid and a monohydric alcohol, and the insulating liquid having an aniline point of from 5 to 80° C.

2. The liquid developer as claimed in claim 1, wherein the insulating liquid contains an aliphatic hydrocarbon.

3. The liquid developer as claimed in claim 2, wherein the aliphatic hydrocarbon is a saturated hydrocarbon.

4. The liquid developer as claimed in claim 1, wherein the insulating liquid contains a silicone oil.

5. The liquid developer as claimed in claim 1, wherein the fatty acid monoester contains a saturated fatty acid as the fatty acid.

6. The liquid developer as claimed in claim 5, wherein the fatty acid monoester contains a saturated fatty acid having from 8 to 16 carbon atoms as the fatty acid.

7. The liquid developer as claimed in claim 1, wherein the fatty acid monoester contains an alcohol having from 1 to 4 carbon atoms as the monohydric alcohol.

8. The liquid developer as claimed in claim 1, wherein a content of the fatty acid monoester in the insulating liquid is from 10 to 90% by weight.

9. The liquid developer as claimed in claim 1, wherein the toner particles have an average particle diameter of from 0.7 to 3 μm.

10. The liquid developer as claimed in claim 1, wherein the toner particles contain a polyester resin.

11. An image forming apparatus comprising:

plural developing parts that form plural monochrome images different in color from each other by using plural liquid developers different in color from each other;

a transferring part that transfers sequentially the plural monochrome images formed in the plural developing parts to a recording medium by conveying the recording medium, to form an unfixed color image having the transferred plural monochrome images superimposed on each other on the recording medium; and a fixing part that fixes the unfixed color image on the recording medium, the liquid developers containing each an insulating liquid having dispersed therein toner particles, the insulating liquid containing a fatty acid monoester that is an ester of a fatty acid and a monohydric alcohol, and the insulating liquid having an aniline point of from 5 to 80° C.

12. The image forming apparatus according to claim 11, wherein the developing parts contain each a developing roller having on a surface thereof a layer of the liquid developer, a photoreceptor having the monochrome image to be formed thereon by transferring the liquid developer on the developing roller, and a coating roller that feeds the liquid developer to the developing roller, and the coating roller is an anilox roller having grooves formed on a surface thereof that feeds the liquid developer to the developing roller by carrying the liquid developer with the grooves.

* * * * *